US006283730B1

(12) United States Patent
Sasaki et al.

(10) Patent No.: US 6,283,730 B1
(45) Date of Patent: Sep. 4, 2001

(54) MICRO PUMP AND METHOD OF PRODUCING THE SAME

(75) Inventors: Yasuhiko Sasaki; Yasuhiro Yoshimura, both of Niihari-gun; Akira Koide, Inashiki-gun; Ryo Miyake, Tsukuba; Naruo Watanabe, Niihari-gun; Takao Terayama, Ushiku; Hiroshi Mitsumaki, Mito; Yasuhiko Ishida; Tomonari Morioka, both of Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/441,230

(22) Filed: Nov. 16, 1999

(30) Foreign Application Priority Data

Nov. 16, 1998 (JP) ..... 10-324759

(51) Int. Cl.[7] ..... F04B 17/00
(52) U.S. Cl. ..... 417/413.3
(58) Field of Search ..... 417/413.3, 413.1, 417/413.2, 412, 410.1; 604/67; 438/770; 400/120.09

(56) References Cited

U.S. PATENT DOCUMENTS 4,826,131 * 5/1989 Mikkor ..... 251/129.17
4,938,742 * 7/1990 Smits ..... 604/67
5,277,556 * 1/1994 van Lintel ..... 417/413 A
5,346,372 * 9/1994 Naruse et al. ..... 417/379
5,718,567 * 2/1998 Rapp et al. ..... 417/395
5,725,363 * 3/1998 Bustgens et al. ..... 417/413.1
5,759,015 * 6/1998 Lintel et al. ..... 417/322
5,814,095 * 9/1998 Muller et al. ..... 607/57
6,164,850 * 12/2000 Speakman ..... 400/120.09
6,194,327 * 2/2001 Gonzalez et al. ..... 438/770

* cited by examiner

*Primary Examiner*—Teresa Walberg
*Assistant Examiner*—Daniel Robinson
(74) *Attorney, Agent, or Firm*—Antonelli, Terry, Stout & Kraus, LLP

(57) ABSTRACT

A micro pump is made compact and can prevent members constituting the micro pump from being chemically reacted with a working fluid, and a method of producing the same. After each of substrates constituting the micro pump is formed by a member containing a silicone as a main composition and a plurality of metal membranes are formed on a whole of a bonding surface of each of the substrates so as to form bonding surfaces, the bonding surfaces are cleaned, and the bonding surfaces are opposed to each other under a vacuum condition, overlapped, heated and pressed so as to be bonded. The valve portion has a beam and a protrusion for sealing as provided in the valve side, whereby a pressure applied to the protrusion becomes smaller than the bonding pressure.

5 Claims, 9 Drawing Sheets

MICRO PUMP AND METHOD OF PRODUCING THE SAME

BACKGROUND OF THE INVENTION

The present invention relates to a micro pump, and particularly to a micro pump for a microscopic fluid control device with employing a micro machining technology in a medical chemical analysis and a method of producing the same.

A micro pump having a valve capable of pre-loading and a method of producing the same are, for example, described in Japanese Patent Unexamined Publication Nos. 4-132887, 5-1669, 5-79460, 5-502083 and the like. Since all of them employ an anode bonding method for assembling the micro pump, a silicone substrate and a glass substrate are used as a member for forming the micro pump.

In the prior arts mentioned above, since the glass substrate is used as a part of the member for forming the micro pump, it is necessary to process a through hole, a groove or the like on the glass substrate. However, there is a problem that since the glass substrate is bad in a processing performance and a processing accuracy is low, it is hard to make the micro pump compact.

Further, since the member (the silicone substrate or the glass substrate) for forming the micro pump is directly brought into contact with a working fluid, the member is chemically reacted with the working fluid, so that a shape of the member is changed and a deposited material is generated. Accordingly, there are problems that a performance of the micro pump is deteriorated and a material characteristic of the working fluid is changed.

OBJECT AND SUMMARY OF THE INVENTION

An object of the present invention is to provide a micro pump which is made compact and can prevent each of elements from being chemically reacted with a working fluid, and a method of producing the same.

The object mentioned above can be achieved by the following method.

After a metal membrane is formed on a whole of a surface on which a member forming a micro pump is bonded as a silicone substrate so as to form bonding surfaces, the bonding surfaces are cleaned, and thereafter, the bonding surfaces are opposed to each other under a vacuum or inert gas circumstance, overlapped and pressed so as to be bonded.

DESCRIPTION OF THE EMBODIMENTS

Figure 1:
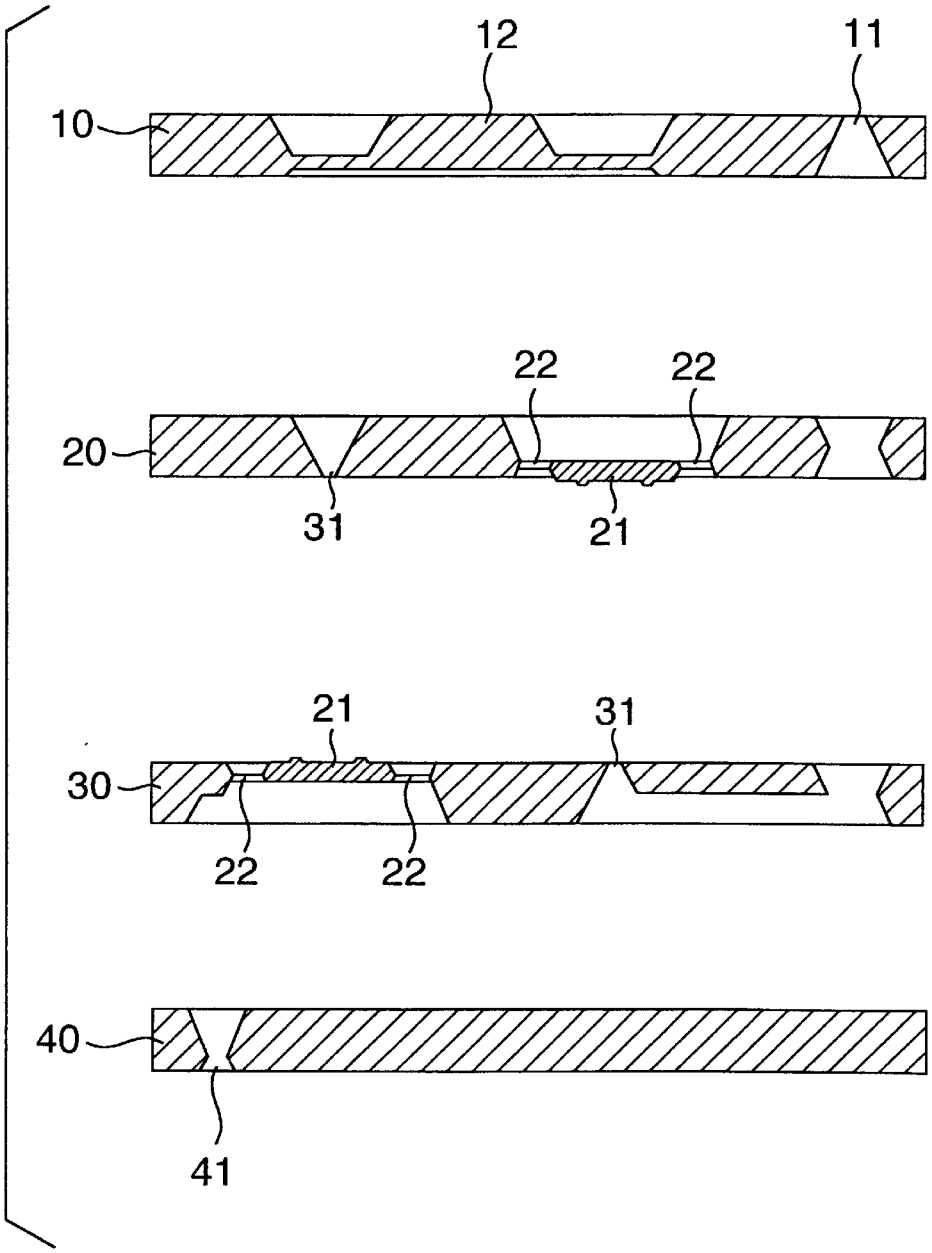
FIG. 1 is a cross sectional view of each of substrates which constitute a micro pump in accordance with a first embodiment of the present invention.

An embodiment in accordance with the present invention will be described below with reference to the accompanying drawings. FIG. 1 shows a cross sectional view of each of a plurality of substrates constituting a micro pump in accordance with the present invention before being bonded.

The micro pump is formed by processing each of substrates comprising a diaphragm substrate 10, a chamber substrate 20, a valve substrate 30 and a nozzle substrate 40 and thereafter bonding them. Each of the substrates has a base material made of a single crystal silicone and a mask made of a thermal oxidation membrane and is etched by a potassium hydroxide water solution so as to form a suction port 11, a diaphragm 12, a port 31, a valve 21, a beam 22, a discharge port 41 and the like.

By heating after the etching process so as to form a thermal oxidation membrane on a whole surface of the substrate, the thermal oxidation membrane is formed even on a portion having a small radius of curvature and generated by the etching and the radius of curvature is increased, thereby increasing a mechanical strength.

Figure 2A:
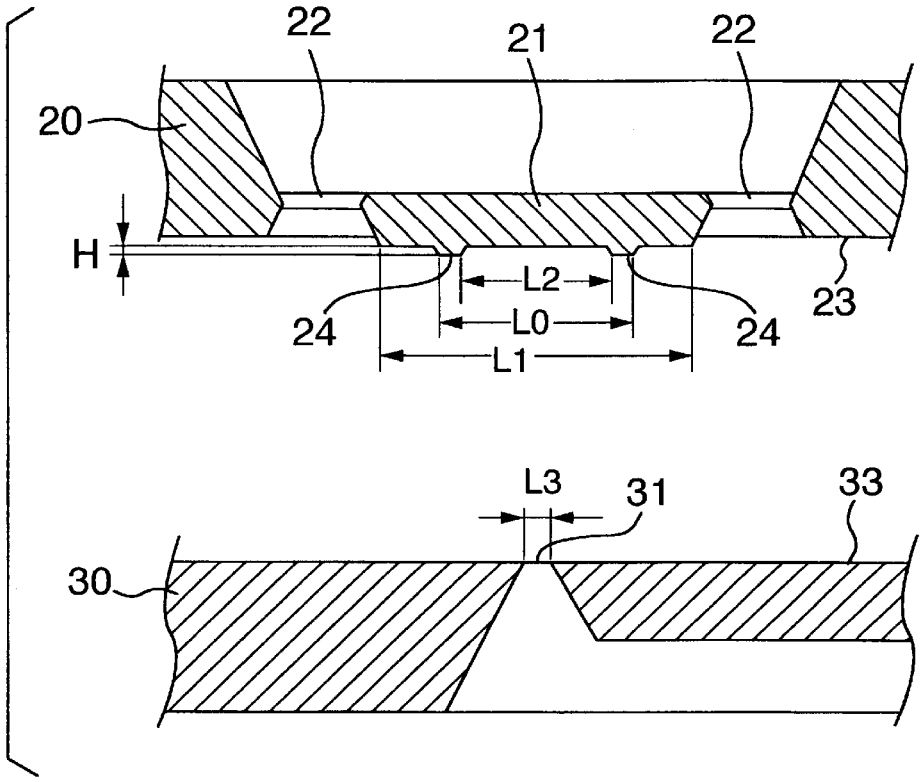
FIGS. 2A and 2B are cross sectional views of a structure of a valve shown in FIG. 1.
Figure 2B:
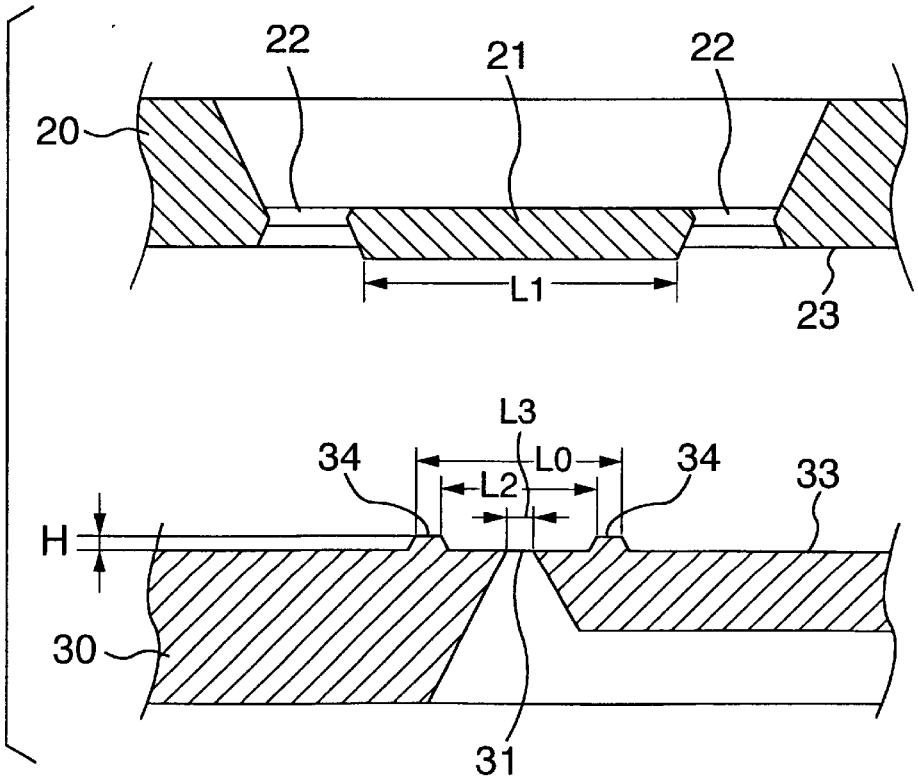

FIGS. 2A and 2B show cross sectional views of a structure of a valve formed on the chamber substrate and a port formed on the valve substrate.

As shown in FIG. 2A, the valve 21 is supported to the chamber substrate 20 by the beam 22. Further, a part of the valve substrate 21 protrudes from a substrate surface 23 and a seal portion 24 is formed in a front end portion thereof. When bonding the chamber substrate 20 to the valve substrate 30, the beam 22 is elastically deformed in accordance with a height at which the seal portion 24 protrudes from the substrate surface 23, and a pressing pressure is generated in the seal portion 24 so as to obtain a pre-load. In this case, an edge of the seal portion 24 is chamfered so as to relax a stress concentration at a time of bonding.

Further, the seal portion 24 is provided in an inner side of the valve 21 (a seal portion outer peripheral size L0<a valve outer peripheral size L1: L0 is a fixed amount or more smaller than L1). Still further, a seal portion inner peripheral size L2 is set to be a fixed amount or more larger than a port inner peripheral size L3 of a port 31 formed in the valve substrate 30 opposing to the seal portion 24. By structuring in the manner mentioned above, the valve 21 is prevented from being adhered due to surrounding of a metal membrane around the seal portion 24 at a time of forming the metal membrane after bonding the chamber substrate 20 to the valve substrate 30. In this case, a fixed amount corresponds to a value two hundred times a height H of the seal portion.

In this case, the valve 21, the beam 22 and the seal portion 24 formed on the valve substrate 30 and the port 31 formed on the chamber substrate 20 also have the same structure.

Further, FIG. 2B shows an embodiment in which a seal portion is provided in a side of the valve substrate 30 in place of the seal portion provided on the valve 21, as shown in FIG. 2A.

The valve 21 is supported to the chamber substrate 20 by the beam 22. A seal portion protruding from a substrate surface 33 is formed around a port 31 of the valve substrate 30. When bonding the chamber substrate 20 to the valve substrate 30, the beam 22 is elastically deformed in accordance with a height total of a protruding amount of the valve 21 and the substrate surface 23 and a protruding amount of the substrate surface 33 and the seal portion 34, and the pressing pressure thereof is generated in the seal portion 24 so as to obtain a pre-load.

Next, a step of assembling the micro pump will be described with reference to FIGS. 3A to 6B.

Figure 3A:
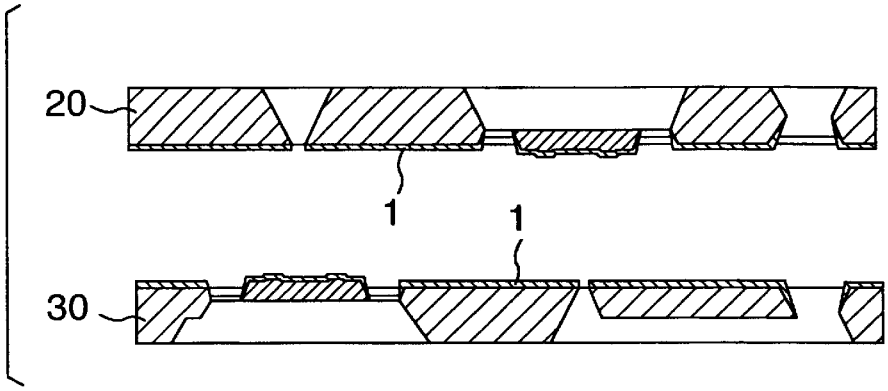
FIGS. 3A, 3B and 3C are cross sectional views of an assembly step of a micro pump in accordance with the present invention.
Figure 3B:
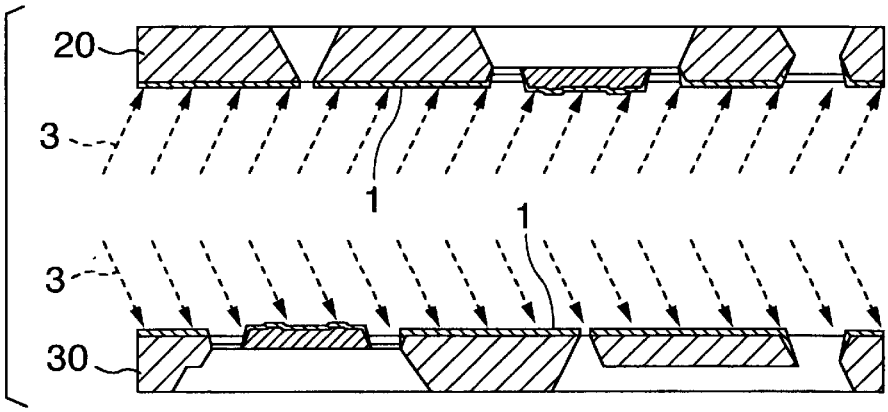
Figure 3C:
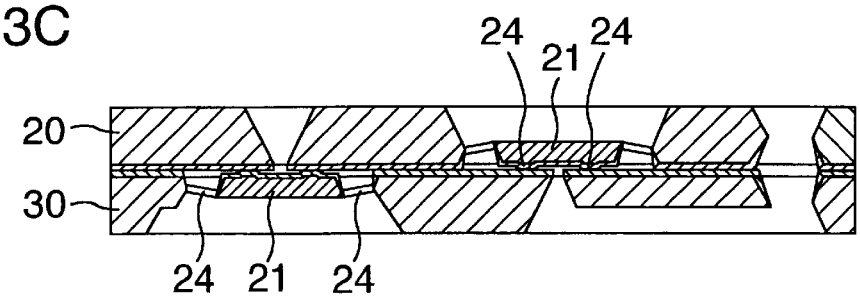
Figure 4A:
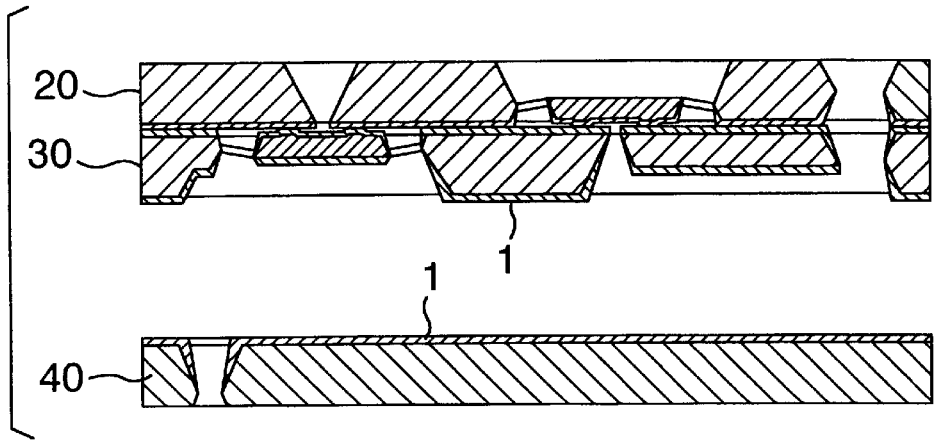
FIGS. 4A, 4B and 4C are cross sectional views of an assembly step of a micro pump in accordance with the present invention.
Figure 4B:
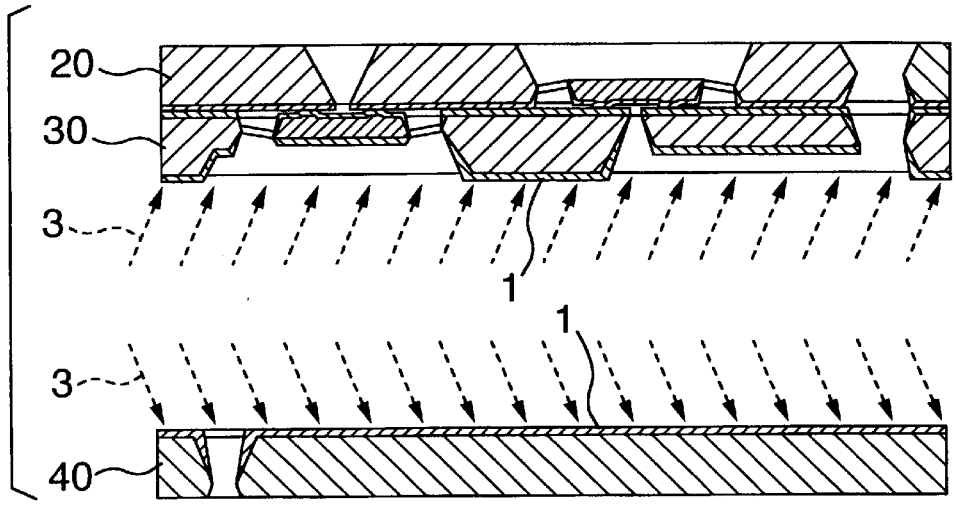
Figure 4C:
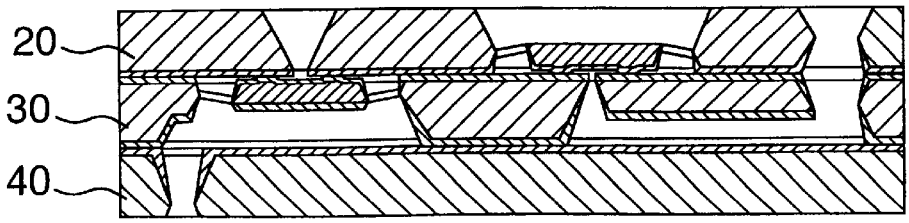
Figure 5A:
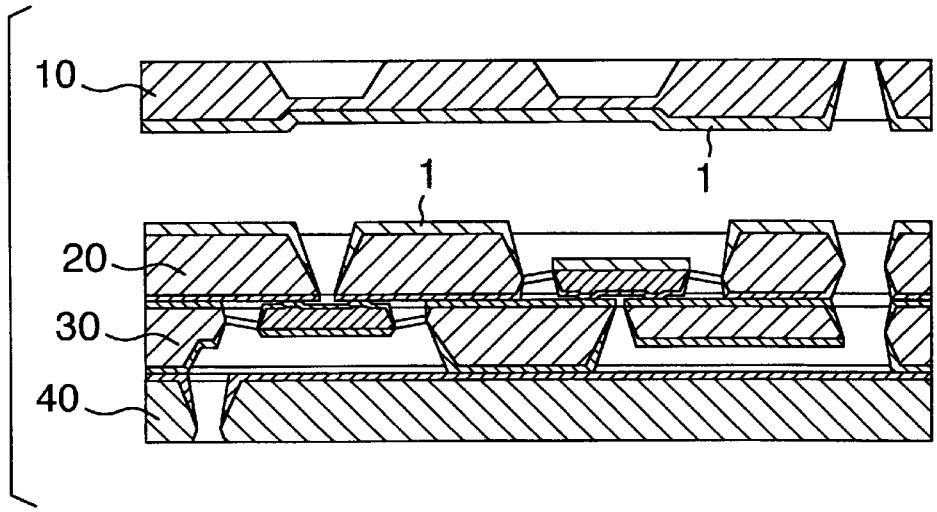
FIGS. 5A, 5B and 5C are cross sectional views of an assembly step of a micro pump in accordance with the present invention.
Figure 5B:
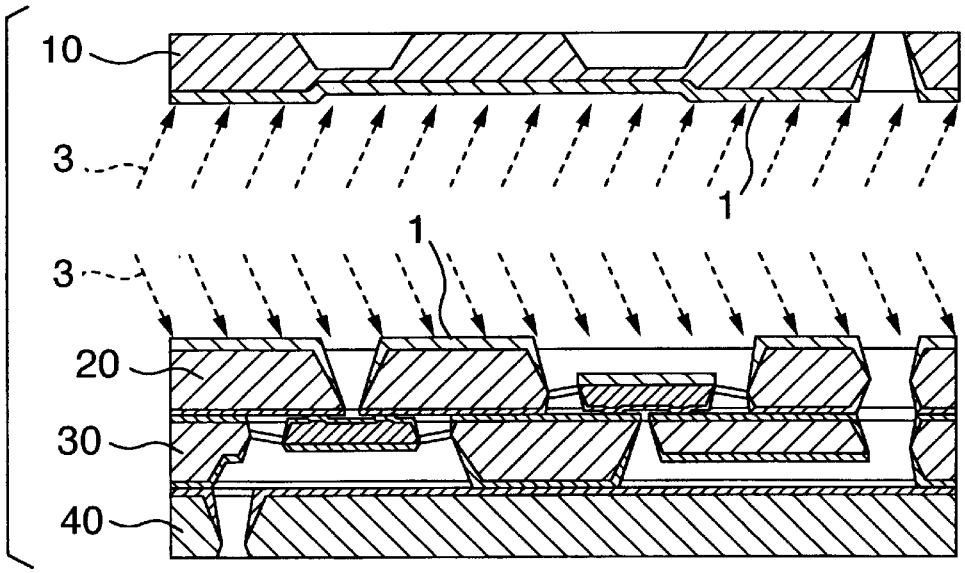
Figure 5C:
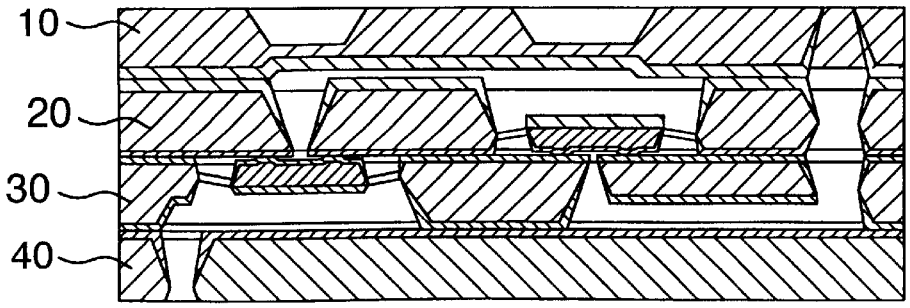

FIG. 3A shows a state before the chamber substrate 20 and the valve substrate 30 are bonded, FIG. 3B shows a state under bonding, and FIG. 3C shows a state at a time of finishing the bonding. FIGS. 4A to 4C show a step of further bonding the nozzle substrate 40 to the chamber substrate 20 and the valve substrate 30 which are bonded in FIGS. 3A to 3C. FIGS. 5A to 5C show a step of bonding the diaphragm substrate 10 to the chamber substrate 20, the valve substrate 30 and the nozzle substrate 40 which are bonded in FIGS. 4A to 4C.

At first, as shown in FIG. 3A, after etching the chamber substrate 20 and the valve substrate 30, a heating process is performed so as to form a thermal oxidation membrane on all the surface of the substrate, and there-after the metal membrane 1 is formed on the whole of the surface to be bonded of both of the substrates so as to form the bonding surface. Thereafter, as shown in FIG. 3B, an Ar plasma 3 is irradiated onto the bonding surface under a vacuum condition. Then, as shown in FIG. 3C, after the bonding surfaces are continuously opposed to each other under a vacuum condition so as to be positioned, they are overlapped with each other and bonded by heating and pressing. At this time, since the seal portion 24 is provided in the valve 21, the partial contact area is small, thereby keeping a state of functioning as the valve with being hardly bonded even at the heating and pressing time.

Next, as shown in FIG. 4A, the metal membrane 1 is formed on the whole of the surfaces on which the bonded body of the chamber substrate 20 and the valve substrate 30 and the nozzle substrate 40 are respectively bonded, thereby forming the bonding surfaces. Thereafter, in the same manner as FIGS. 3B and 3C, the bonding surfaces are bonded in accordance with FIGS. 4B and 4C.

Then, as shown in FIG. 5A, the metal membrane 1 is formed on the whole of the surfaces on which the bonded body of the chamber substrate 20, the valve substrate 30 and the nozzle substrate 40 and the diaphragm substrate 10 are respectively bonded, thereby forming the bonding surfaces. Thereafter, the bonding surfaces are bonded in accordance with FIGS. 5B and 5C corresponding to the same procedures as those of FIGS. 3B and 3C.

Figure 6A:
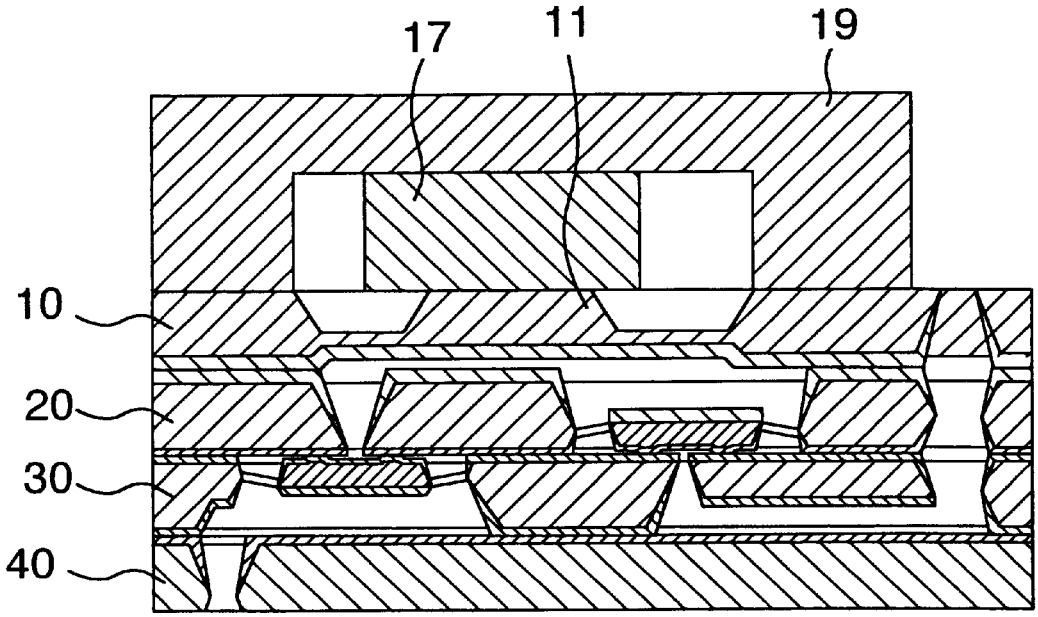
FIGS. 6A and 6B are cross sectional views of an assembly step of a micro pump in accordance with the present invention.
Figure 6B:
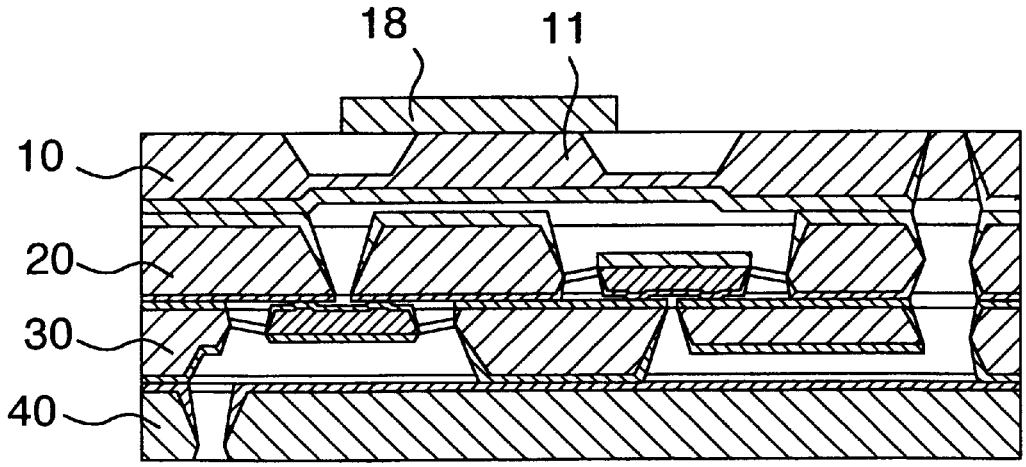

FIGS. 6A and 6B show procedures of disposing a drive source such as a piezoelectric element and the like to the bonded body assembled in FIGS. 5A to 5C.

After bonding four kinds of substrates in accordance with the procedures mentioned above, as shown in FIG. 6A, a laminated piezoelectric element 17 corresponding to an actuator for driving the diaphragm is adhered to the diaphragm 11. Further, the micro pump is assembled by connecting a fixing jig 19 to the diaphragm substrate 10 with a high rigidity in accordance with a bonding operation. In this case, in the case of employing a piezoelectric disc 18 as the actuator for driving the diaphragm, as shown in FIG. 6B, the micro pump is assembled by adhering the piezoelectric disc 18 to the diaphragm 11.

The laminated piezoelectric element 17 in FIG. 6A is structured such as to apply a displacement to the diaphragm in accordance with a vertical displacement of the element, however, since the piezoelectric disc in FIG. 6B is structured such as to apply a displacement in accordance with a lateral displacement of the disc, the fixing jig which is necessary in the laminated piezoelectric element 17 is not required, and further, a thickness thereof can be made small, so that the structure can be made simple and compact.

In this case, the metal membrane formed on each of the substrate surfaces is formed by a sputtering in the order of Ti (a membrane thickness is 0.05 $\mu$m), Pt (a membrane thickness is 0.1 $\mu$m) and Au (a membrane thickness is 1 $\mu$m) on the substrate surface (the thermal oxidation membrane). Further, an atmospheric pressure during a series of steps under a vacuum condition is 0.3 mPa, an amount of irradiating Ar atom to the bonding surface is 10 nm at Au etching amount, a bonding temperature is 150° C. and a bonding pressure is 10 Mpa.

Here, in FIG. 3C, when 10 Mpa of bonding pressure is applied to the chamber substrate 20 and the valve substrate 30, the pressing pressure between the seal portion 24 of the valve 21 and the valve substrate 30 is 0.4 Mpa, and it is recognized that the seal portion 24 of the valve 21 and the valve substrate 30 are not bonded at a pressure less than this pressure. That is, a thickness and a length are defined so that an elastic force applied to the beam 22 is equal to or less than 0.4 Mpa.

As mentioned above, by constituting the micro pump by bonding a plurality of substrates having a silicone as a base material, a processing accuracy is improved and it is possible to make the pump compact. Further, since the metal membrane is formed in the portion with which the working fluid is brought into contact at the same time when the metal membrane forming the bonding surface is formed, and the surface thereof is made of Au, it is hard to chemically react with the working fluid.

Figure 7A:
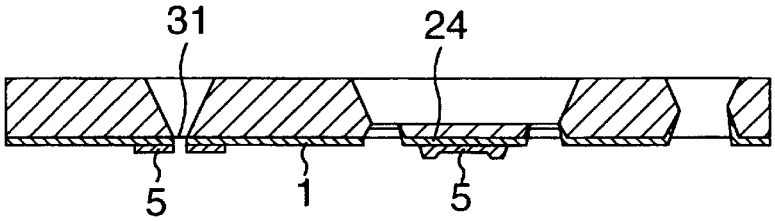
FIGS. 7A and 7B are cross sectional views of a structure in the case of forming a barrier material in accordance with an embodiment 2 of the present invention.
Figure 7B:
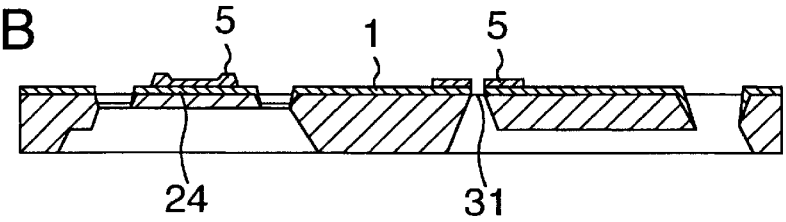

A second embodiment in accordance with the present invention will be described below with reference to FIGS. 7A and 7B. FIGS. 7A and 7B show cross sections of the chamber substrate 20 and the valve substrate 30.

It is different from the preceding embodiment in view that a barrier material 5 is provided on the surface of the valve 21 and in the periphery of the port 31. The manufacturing step thereof will be described below. In the same manner as FIG. 3A with respect to the first embodiment, the metal film 1 is formed on the whole of the surfaces to which the chamber substrate 20 and the valve substrate 30 are respectively bonded, thereby forming the bonding surface. Thereafter, the barrier material 5 is formed on the seal portion 24 and the peripheral portion of the port 31 opposing to the seal portion 24 in accordance with a spattering by using a metal mask. In this case, the barrier material 5 is made of Pt (a membrane thickness is 0.1 $\mu$m) or W (a membrane thickness is 0.1 $\mu$m). In this case, an assembly of both of the substrates in accordance with bonding is performed by the same step as that of the embodiment 1 mentioned above.

As a result, when the chamber substrate 20 and the valve substrate 30 are pressed by a bonding pressure of 10 Mpa, a pressing pressure between the seal portion 24 of the valve 21 and the valve substrate 30 becomes 0.6 Mpa, and it is recognized that the seal portion 24 of the valve 21 and the valve substrate 30 are not bonded at the pressure equal to or less than this pressure.

As mentioned above, by forming the barrier material in the seal portion and the peripheral portion of the port opposing to the seal portion, it is possible to produce the micro pump without the valve being adhered to the port side substrate at a time of bonding the respective substrate even in the case of increasing the pressing pressure in the seal portion.

Figure 8A:
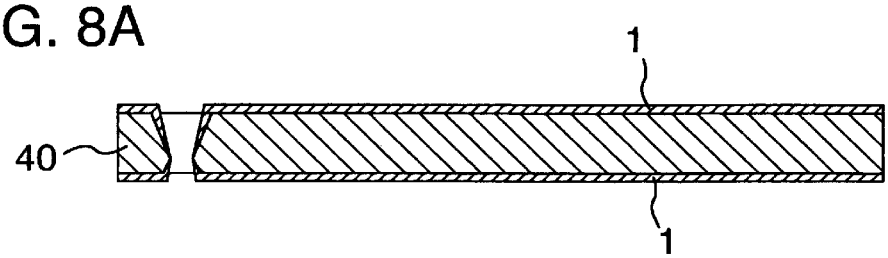
FIGS. 8A, 8B and 8C are cross sectional views of a structure in the case of forming a fluorine resin membrane in accordance with an embodiment 3 of the present invention.
Figure 8B:
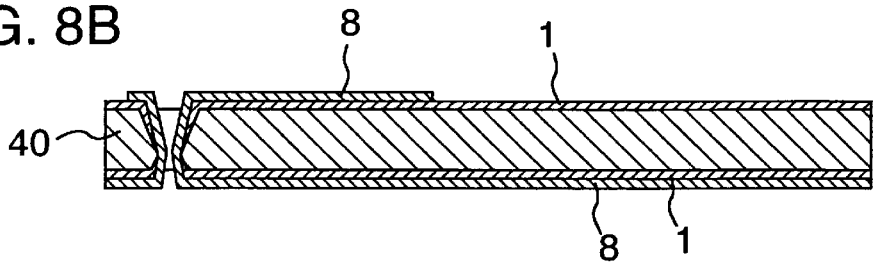
Figure 8C:
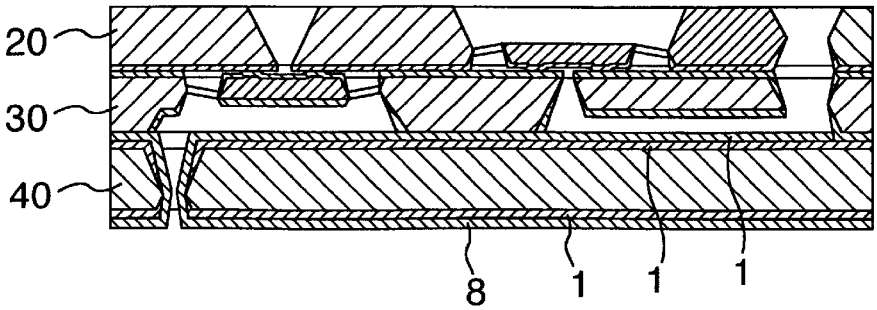

Next, a third embodiment will be described with reference to FIGS. 8A to 8C. FIGS. 8A to 8C are cross sectional views of a step of forming a fluorine resin membrane as a water repellent coating.

At first, as shown in FIG. 8A, the metal membrane is sputtered on both of the surfaces of the nozzle substrate 40 in the order of Ti (a membrane thickness is 0.05 $\mu$m), Pt (a membrane thickness is 0.1 $\mu$m) and Au (a membrane thickness is 1 $\mu$m).

Next, as shown in FIG. 8B, a fluorine resin containing paint is applied onto both of the surfaces of the nozzle substrate 40 in a state of overlapping the metal mask only on the surface to be bonded to the valve substrate. Thereafter, the nozzle substrate 40 is thermally treated so as to form the fluorine resin membrane 8. in this case, at a time of forming the fluorine resin membrane 8, the same fluorine resin membrane can be formed by using a tape or a resist in place of the metal mask, and in this case, a dipping can be performed.

FIG. 8C is a cross sectional view of the micro pump after the same assembling step as that of the embodiment 1 by using the valve substrate on which the fluorine resin membrane is formed. An end portion of the fluorine resin membrane 8 formed in the bonding surface side is gripped between Au in the metal membrane 1 of the nozzle substrate 40 and the bonding surface of Au in the metal membrane 1 of the valve substrate 30 at a time of bonding. Accordingly, since the end portion of the fluorine resin membrane is not in contact with the working fluid, a chemicals resistance of the fluorine resin membrane is improved.

Figure 9A:
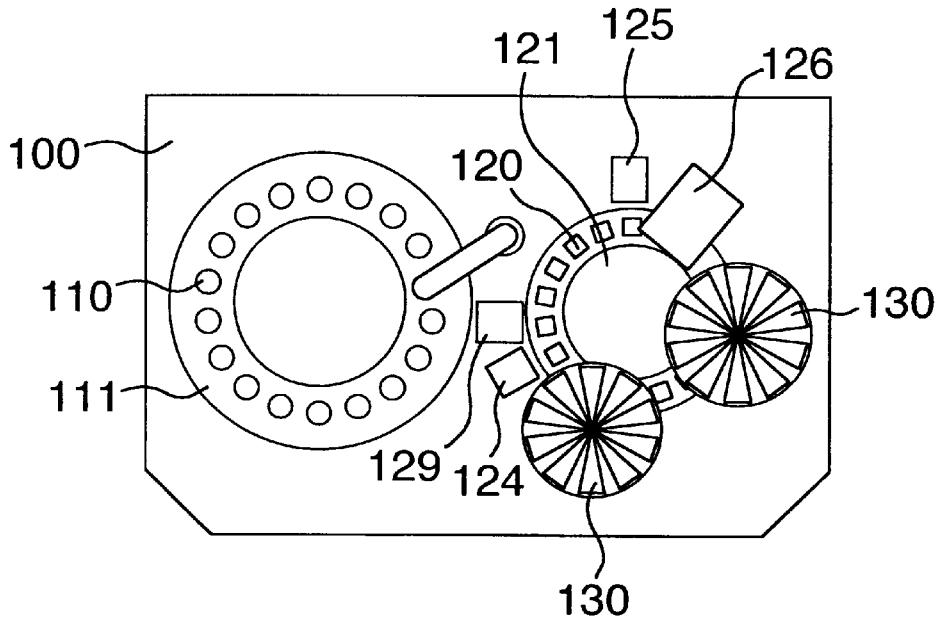
FIGS. 9A and 9B are schematic views of an automatic analyzing apparatus on which a micro pump in accordance with the present invention is mounted.
Figure 9B:
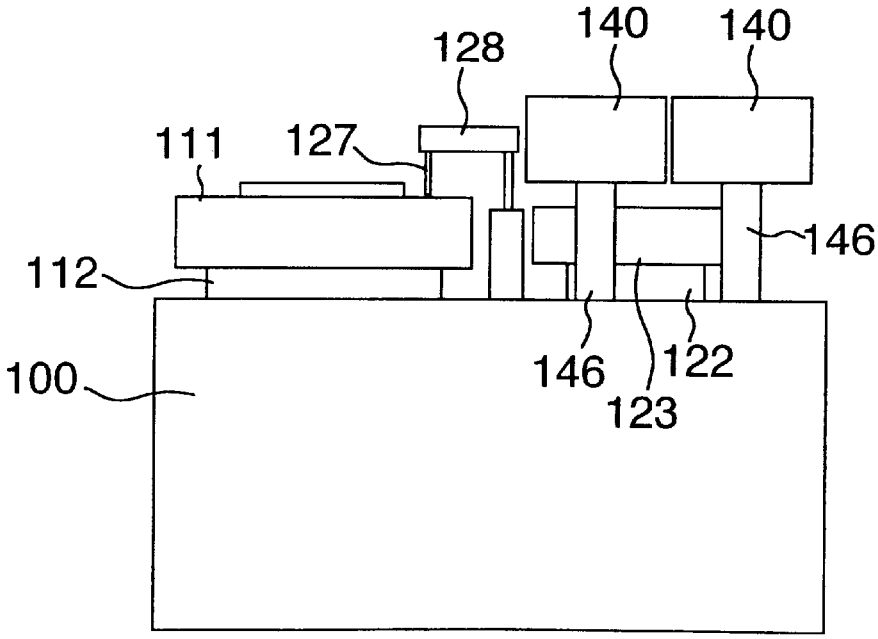

FIGS. 9A and 9B show an automatic analyzing apparatus as an embodiment in which the micro pump is employed. An automatic analyzing apparatus 100 is structured as follows.

At first, it is provided with a sample container holder 111 capable of receiving at least one sample container 110 in which a sample to be measured is received, and a sample container holder rotating mechanism 112 for transferring the sample container 110 received in the sample container holder 111 to a sample suction position.

Further, it is provided with a reaction container holder 121 capable of receiving a plurality of reaction containers 120 for receiving a sample and at least one reagent so as to react, and a reaction container holder rotating mechanism 122 for transferring the reaction container 120 received in the reaction container holder 121 to a sample discharging position, a first reagent discharging position and a second reagent discharging position.

Still further, it is provided with a sample pipetter 128 which inserts a nozzle 127 into the sample container 110 transferred to the sample suction position so as to suck a sample from the sample container 110 and pipette a desired amount within the reaction container at the sample discharging position, a sample pipetter cleaning mechanism 129 for cleaning the sample pipetter 128, and a thermostat tank 123 for keeping the sample and the reagent within the reaction container 120 to a fixed temperature.

Furthermore, it is provided with a reagent container 130 which receives a reagent in correspondence to an item to be measured, a micro pump 54 for supplying a reagent mounted to the reagent container 130 (refer to FIG. 10), and a reagent container holder rotating mechanism 146 which transfers the reagent container 130 provided with the micro pump 54 to the reagent discharging position. In this case, the reagent container 130 and the micro pump 54 are structured such that they can be easily attached and detached as mentioned below, and are used in combination at each of the reagent containers.

By structuring in this manner, it is unnecessary to provide a pipetter apparatus for supplying the reagent which has been independently provided in a prior art in a side of a analyzing apparatus main body, a whole structure of the apparatus can be made compact, and further, since the supply apparatus is provided at each of the reagent apparatuses, it is possible to prevent a contamination due to another kind of reagent supplied by the supply apparatus. Further, since it is sufficient to scrap only the reagent container, it is possible to reduce an amount of the scrap.

In this case, in the automatic analyzing apparatus in accordance with the present embodiment, there is further provided a mixing mechanism 124 for mixing the sample in the reaction container 120 and at least one kind of reagent. Further, it is constituted by an optical spectrum measuring portion 125 for measuring a change of an absorbance due to a reaction between the sample and at least one kind of reagent supplied into the reaction container 120, and a reaction container cleaning mechanism 126 for cleaning the reaction container 120 after the optical spectrum measurement is finished.

Figure 10:
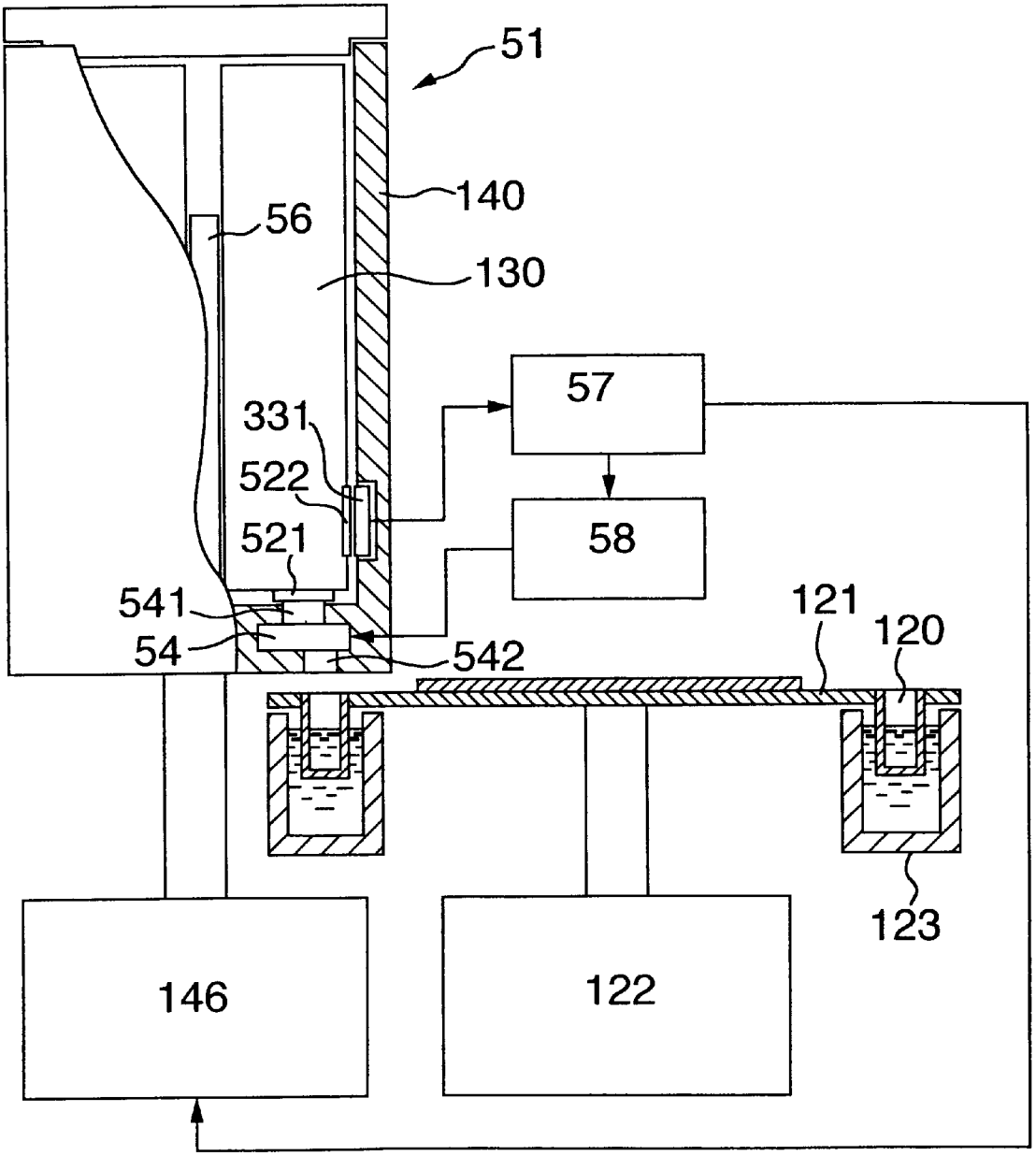
FIG. 10 is a detailed view of a reagent supply portion shown in FIGS. 9A and 9B.

FIG. 10 shows a detailed schematic view of the reagent supply portion in accordance with the present invention.

The reagent supply portion 51 is mainly constituted by four portions comprising the reagent container 130, the reagent holder 14, the micro pump 54 and the reagent holder rotating mechanism 146. The reagent holder 140 is structured such as to hold the reagent container 130 around a center axis 56 in a circumferential manner. The same number of micro pumps 54 as the number of the held reagent containers are provided in a bottom portion of the reagent holder 140. A connection hole 521 is provided on a bottom surface of the reagent container 130, and is structured such as to be connected to a suction hole 541 of the micro pump 54 by being strongly pressed toward the bottom portion of the reagent holder 140.

Further, a protruding hole 542 is provided in the micro pump 54 toward a vertical downward direction. A magnetic recording portion 522 which records a kind, a using amount and the like of the reagent is provided on a side surface of the reagent container 130. Further, a magnetic recording and reproducing mechanism 531 is provided in the reagent holder 140 opposing to the magnetic recording portion 522. A signal line from the magnetic recording and reproducing mechanism 531 is connected to a judging portion 57. Further, the judging portion 57 is connected to a micro pump control portion 58. The micro pump 54 is driven by a micro pump control portion 58. The reagent holder 140 is rotated by the reagent holder rotating mechanism 146.

Here, in the embodiments mentioned above, a magnetism is employed for recording the kind and the like of the reagent container, however, a light may be employed.

As mentioned above, by employing the micro pump in accordance with the present invention for supplying the reagent, it is possible to supply the reagent to the reaction container at a high accuracy, so that it is possible to analyze at a high accuracy. Further, since the micro pump is provided at each of the reagent containers, there can be obtained an effect such that no contamination between the reagents is generated.

In accordance with the present invention, an accuracy of processing the substrate constituting the micro pump is improved, and it is possible to realize a compact structure of the micro pump. Further, the member forming the micro pump is hard to chemically react with the working fluid. Still further, it is possible to increase the pressing pressure in the seal portion by forming the barrier material, so that a strong pump can be realized.

What is claimed is:

1. A micro pump comprising:

a nozzle substrate;

a valve substrate bonded to said nozzle substrate at one surface thereof;

a chamber substrate bonded to the other surface side of said valve substrate; and a diaphragm substrate bonded to a surface opposite to a surface of said chamber substrate bonded to said valve substrate, wherein each of said substrates is made of a silicone as a base material, a metal membrane is formed on a whole surface of each of said substrates in the bonding side, and said bonding portions are bonded to each other by heating and pressing.

2. A micro pump as claimed in claim 1, wherein said metal membrane is formed by laminating different metals, and the metal membrane on the surface is made of Au.

3. A micro pump as claimed in claim 1, wherein a valve supported by a beam is provided in said valve substrate and said chamber substrate, a seal portion is formed on said valve, said valve and said seal portion protrude from the substrate surface forming them, and said beam is deformed by bonding said valve substrate and said chamber substrate, whereby a pressing pressure generated due to said deformation becomes equal to or less than a pressure necessary for a bonding between the substrates.

4. A method of producing a micro pump including a nozzle substrate, a valve substrate, a chamber substrate and a diaphragm substrate, each of said substrates being formed by a material having a silicone as a base material, comprising the steps of:

forming a discharge port in said nozzle substrate, a port, a valve and a beam for supporting the valve to the substrate in said valve substrate and said chamber substrate, and a suction port and a diaphragm in said diaphragm substrate, in accordance with an etching, respectively;

forming a thermal oxidation membrane by performing a heat treatment after said etching process is finished;

laminating a plurality of metal membranes on a whole surface of each of the substrates in the bonding surface side;

cleaning said metal membrane surface after forming said metal membrane; and opposing said bonding surfaces under a vacuum condition or an inert atmosphere so as to press and bond.

5. A method of producing a micro pump as claimed in claim 4, wherein the membrane on the surface of said metal membrane is made of Au.

* * * * *